US011639823B2

(12) United States Patent
May et al.

(10) Patent No.: US 11,639,823 B2
(45) Date of Patent: May 2, 2023

(54) METHOD OF OPERATING A LIGHTING ASSEMBLY IN A REFRIGERATOR APPLIANCE

(71) Applicant: Haier US Appliance Solutions, Inc., Wilmington, DE (US)

(72) Inventors: Jason Andrew May, Prospect, KY (US); Jarvis Ward, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 144 days.

(21) Appl. No.: 17/226,612

(22) Filed: Apr. 9, 2021

(65) Prior Publication Data

US 2022/0325943 A1 Oct. 13, 2022

(51) Int. Cl.

| | |
|---|---|
| ***F25D 1/00*** | (2006.01) |
| ***F25D 27/00*** | (2006.01) |
| ***F25D 11/02*** | (2006.01) |
| ***F25D 17/06*** | (2006.01) |
| ***F25D 17/04*** | (2006.01) |

(52) U.S. Cl.

CPC ..... *F25D 27/005* (2013.01); *F25D 11/02* (2013.01); *F25D 17/045* (2013.01); *F25D 17/065* (2013.01)

(58) Field of Classification Search

CPC ..... F25D 11/02; F25D 17/045; F25D 17/065; F25D 27/005; F25D 2700/123

See application file for complete search history.

(56) References Cited

U.S. PATENT DOCUMENTS

| | | | | |
|---|---|---|---|---|
| 7,568,358 | B2 * | 8/2009 | Wetekamp | F25D 27/005 62/126 |
| 9,140,486 | B2 | 9/2015 | Hupfer | |
| 9,795,010 | B2 | 10/2017 | Kendall | |
| 10,371,438 | B2 * | 8/2019 | Ammerman | G06F 3/04847 |
| 2004/0182105 | A1 * | 9/2004 | Nam | F25D 17/045 62/187 |
| 2014/0111118 | A1 | 4/2014 | Kendall | |
| 2014/0268646 | A1 | 9/2014 | Kendall | |
| 2015/0035432 | A1 | 2/2015 | Randell | |
| 2020/0296908 | A1 * | 9/2020 | Chopko | A01G 9/246 |

FOREIGN PATENT DOCUMENTS

| | | |
|---|---|---|
| EP | 1887298 B1 | 2/2019 |
| JP | 6719263 B2 | 7/2020 |

* cited by examiner

*Primary Examiner* — Filip Zec

(74) *Attorney, Agent, or Firm* — Dority & Manning, P.A.

(57) ABSTRACT

A refrigerator appliance includes a chilled chamber defining a plurality of cooling zones and a lighting assembly comprising a plurality of lighting zones corresponding to the plurality of cooling zones. A climate control system generates and selectively directs a flow of cooling air into the plurality of cooling zones such that the temperature in each zone is independently regulated and the lighting assembly selectively illuminates the plurality of lighting zones to provide user feedback regarding the operation of the climate control system, e.g., by indicating which zones are receiving the flow of cooling air, by notifying a user when a zone has reached a setpoint temperature, or by identifying the presence and location of a flow restriction.

20 Claims, 9 Drawing Sheets

METHOD OF OPERATING A LIGHTING ASSEMBLY IN A REFRIGERATOR APPLIANCE

FIELD OF THE INVENTION

The present subject matter relates generally to refrigerator appliances, and more particularly to lighting systems for refrigerator appliances.

BACKGROUND OF THE INVENTION

Refrigerator appliances generally include a cabinet that defines a chilled chamber for receipt of food articles for storage. In addition, refrigerator appliances include one or more doors rotatably hinged to the cabinet to permit selective access to food items stored in chilled chamber(s). The refrigerator appliances can also include various storage components mounted within the chilled chamber and designed to facilitate storage of food items therein. Such storage components can include racks, bins, shelves, or drawers that receive food items and assist with organizing and arranging of such food items within the chilled chamber.

In addition, conventional refrigerator appliances include lighting systems that illuminate the chilled chamber. However, these conventional lighting systems are intended only to improve visibility within the chamber. In this regard, these conventional lighting systems are passively operated, e.g., the lighting system is activated when a door switch indicates that the door is open and the lighting system is deactivated when the door switch indicates that the door is closed. Moreover, conventional lighting systems lack versatility and the ability to communicate information regarding appliance operation. In this regard, even when the lighting systems are energized, they operate at a single, uniform intensity and color throughout the chilled chamber.

Accordingly, a refrigerator appliance with an improved lighting system would be useful. More particularly, a lighting system for a refrigerator appliance that provides versatile lighting configurations, improved aesthetics, and a more informative user experience would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a refrigerator appliance is provided including a cabinet, a chilled chamber defined within the cabinet, the chilled chamber comprising a plurality of cooling zones, a climate control system for selectively providing a flow of cooling air into the plurality of cooling zones such that each zone of the plurality of cooling zones is cooled independently of every other zone of the plurality of cooling zones, a lighting assembly comprising a plurality of lighting zones corresponding to the plurality of cooling zones, and a controller in operative communication with the climate control system and the lighting assembly. The controller is configured to receive a command to regulate a temperature within a selected zone of the plurality of cooling zones, adjust operation of the climate control system to adjust the temperature within the selected zone, identify a selected lighting zone of the plurality of lighting zones that corresponds to the selected zone, and illuminate the selected lighting zone to provide feedback regarding the operation of the climate control system.

In another exemplary embodiment, a method of operating a refrigerator appliance is provided. The refrigerator appliance includes a chilled chamber defining a plurality of cooling zones, a climate control system for selectively providing a flow of cooling air into the plurality of cooling zones, and a lighting assembly comprising a plurality of lighting zones corresponding to the plurality of cooling zones. The method includes receiving a command to regulate a temperature within a selected zone of the plurality of cooling zones, adjusting operation of the climate control system to adjust the temperature within the selected zone, identifying a selected lighting zone of the plurality of lighting zones that corresponds to the selected zone, and illuminating the selected lighting zone to provide feedback regarding the operation of the climate control system.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
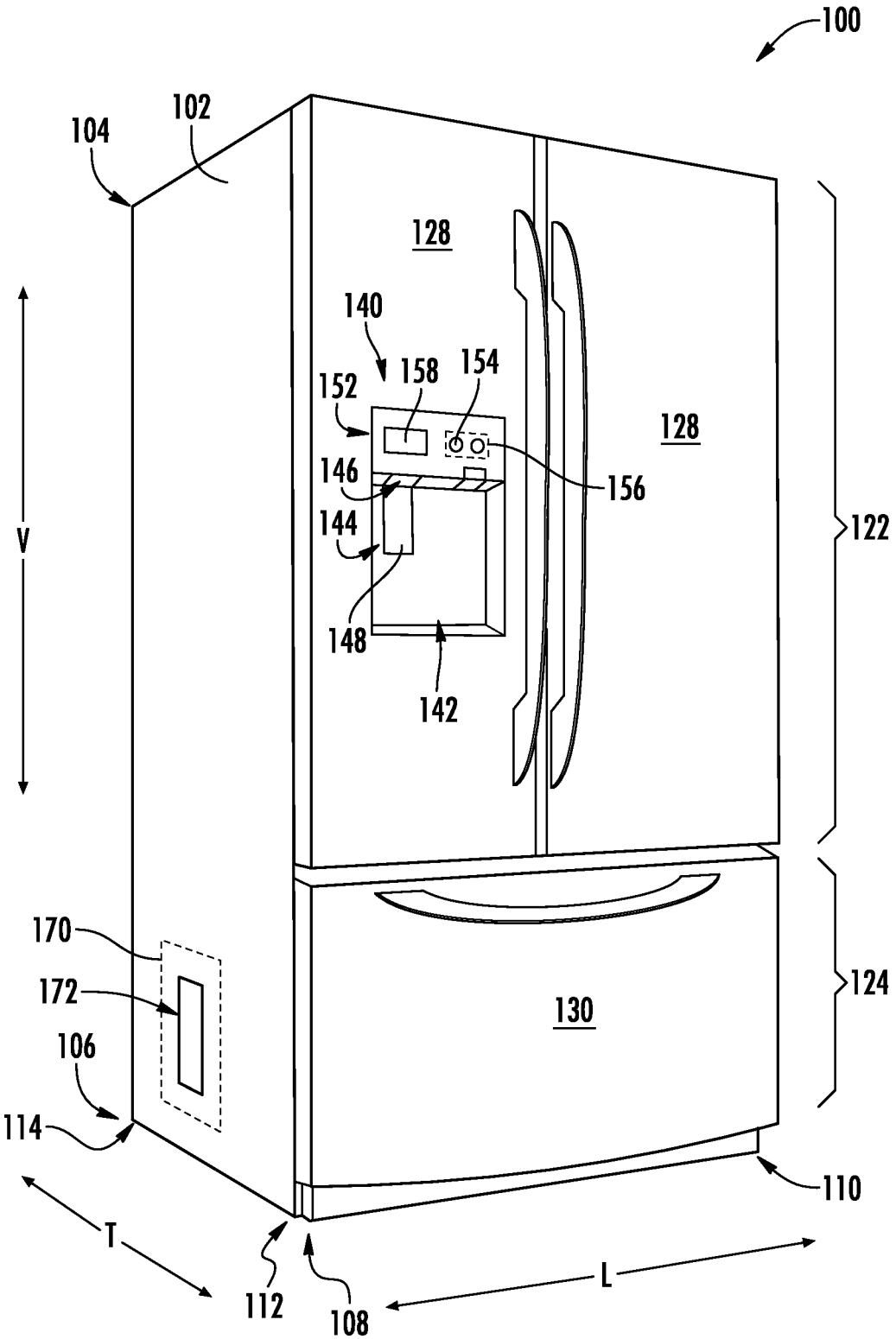
FIG. 1 provides a perspective view of a refrigerator appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

FIG. 1 provides a perspective view of a refrigerator appliance 100 according to an exemplary embodiment of the present subject matter. Refrigerator appliance 100 includes a housing or cabinet 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another and form an orthogonal direction system.

Cabinet 102 defines chilled chambers for receipt of food items for storage. In particular, cabinet 102 defines fresh food chamber 122 positioned at or adjacent top 104 of cabinet 102 and a freezer chamber 124 arranged at or adjacent bottom 106 of cabinet 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance, or a single door refrigerator appliance. Moreover, aspects of the present subject matter may be applied to other appliances as well, such as other appliances including fluid dispensers. Consequently, the description set forth herein is for illustrative purposes only and is not intended to be limiting in any aspect to any particular appliance or configuration.

Refrigerator doors 128 are rotatably hinged to an edge of cabinet 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. To prevent leakage of cool air, refrigerator doors 128, freezer door 130, and/or cabinet 102 may define one or more sealing mechanisms (e.g., rubber gaskets, not shown) at the interface where the doors 128, 130 meet cabinet 102. It should be appreciated that doors having a different style, position, or configuration are possible within the scope of the present subject matter.

Figure 2:
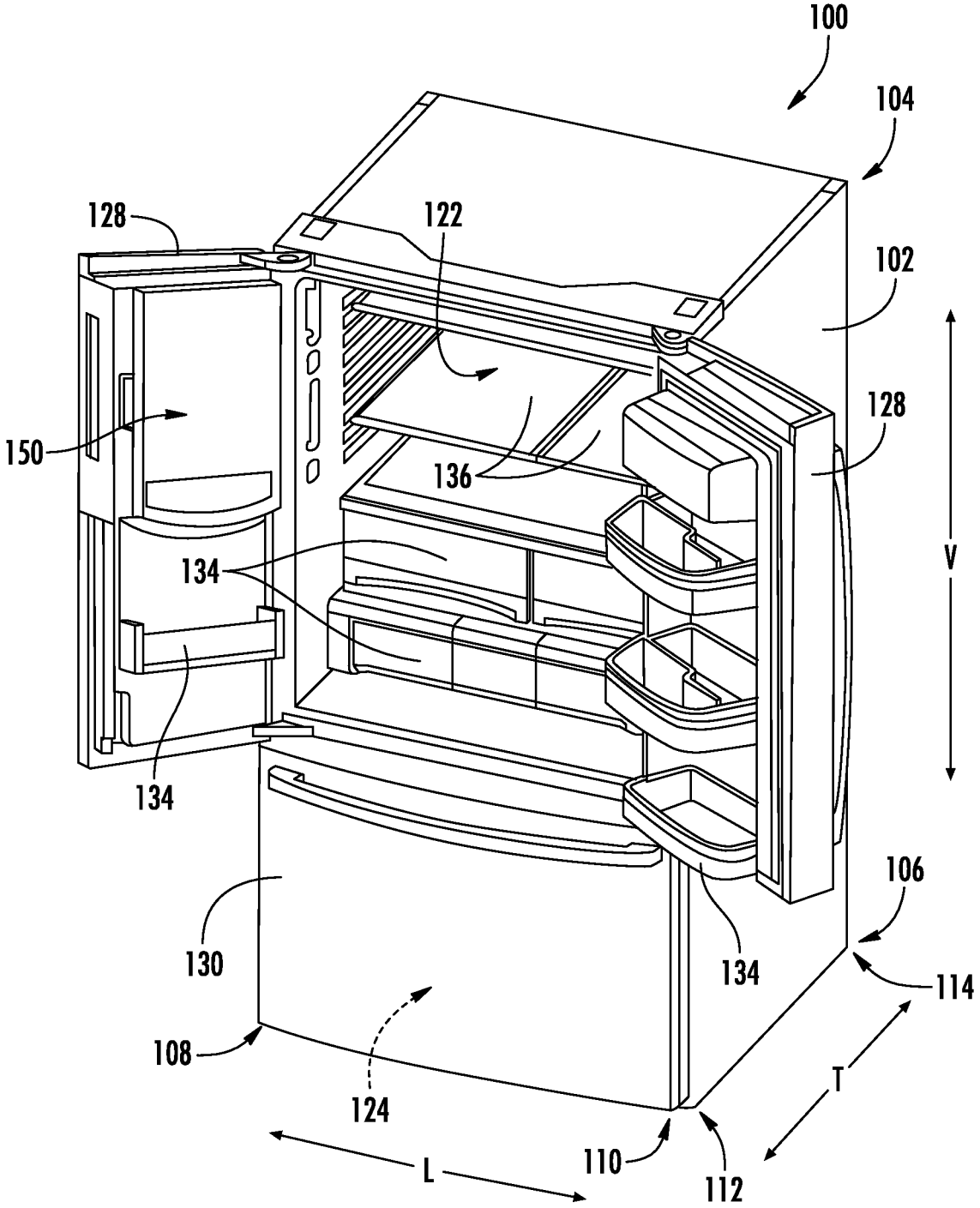
FIG. 2 provides a perspective view of the exemplary refrigerator appliance of FIG. 1, with the doors of the fresh food chamber shown in an open position.

FIG. 2 provides a perspective view of refrigerator appliance 100 shown with refrigerator doors 128 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items) and may assist with organizing such food items. As illustrated, bins 134 may be mounted on refrigerator doors 128 or may slide into a receiving space in fresh food chamber 122. It should be appreciated that the illustrated storage components are used only for the purpose of explanation and that other storage components may be used and may have different sizes, shapes, and configurations.

Referring again to FIG. 1, a dispensing assembly 140 will be described according to exemplary embodiments of the present subject matter. Although several different exemplary embodiments of dispensing assembly 140 will be illustrated and described, similar reference numerals may be used to refer to similar components and features. Dispensing assembly 140 is generally configured for dispensing liquid water and/or ice. Although an exemplary dispensing assembly 140 is illustrated and described herein, it should be appreciated that variations and modifications may be made to dispensing assembly 140 while remaining within the present subject matter.

Dispensing assembly 140 and its various components may be positioned at least in part within a dispenser recess 142 defined on one of refrigerator doors 128. In this regard, dispenser recess 142 is defined on a front side 112 of refrigerator appliance 100 such that a user may operate dispensing assembly 140 without opening refrigerator door 128. In addition, dispenser recess 142 is positioned at a predetermined elevation convenient for a user to access ice and enabling the user to access ice without the need to bend-over. In the exemplary embodiment, dispenser recess 142 is positioned at a level that approximates the chest level of a user.

Dispensing assembly 140 includes an ice dispenser 144 including a discharging outlet 146 for discharging ice from dispensing assembly 140. An actuating mechanism 148, shown as a paddle, is mounted below discharging outlet 146 for operating ice or water dispenser 144. In alternative exemplary embodiments, any suitable actuating mechanism may be used to operate ice dispenser 144. For example, ice dispenser 144 can include a sensor (such as an ultrasonic sensor) or a button rather than the paddle. Discharging outlet 146 and actuating mechanism 148 are an external part of ice dispenser 144 and are mounted in dispenser recess 142. By contrast, refrigerator door 128 may define an icebox compartment 150 (FIG. 2) housing an icemaker and an ice storage bin (not shown) that are configured to supply ice to dispenser recess 142.

A control panel 152 is provided for controlling the mode of operation. For example, control panel 152 includes one or more selector inputs 154, such as knobs, buttons, touch-screen interfaces, etc., such as a water dispensing button and an ice-dispensing button, for selecting a desired mode of operation such as crushed or non-crushed ice. In addition, inputs 154 may be used to specify a fill volume or method of operating dispensing assembly 140. In this regard, inputs 154 may be in communication with a processing device or controller 156. Signals generated in controller 156 operate refrigerator appliance 100 and dispensing assembly 140 in response to selector inputs 154. Additionally, a display 158, such as an indicator light or a screen, may be provided on control panel 152. Display 158 may be in communication with controller 156, and may display information in response to signals from controller 156.

As used herein, "processing device" or "controller" may refer to one or more microprocessors or semiconductor devices and is not restricted necessarily to a single element. The processing device can be programmed to operate refrigerator appliance 100, dispensing assembly 140 and other components of refrigerator appliance 100. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations.

Referring again briefly to FIG. 1, according to an exemplary embodiment, cabinet 102 also defines a mechanical compartment 170 at or near the bottom 106 of the cabinet 102 for receipt of a hermetically sealed cooling system 172. In general, sealed cooling system 172 is configured for transporting heat from the inside of refrigerator appliance 100 to the outside (e.g., by executing a vapor-compression cycle or another suitable refrigeration cycle). As is generally understood by those of skill in the art, the hermetically sealed system 172 contains a working fluid, e.g., refrigerant, which flows between various heat exchangers of the sealed system 172 where the working fluid changes phases while transferring thermal energy.

Figure 5:
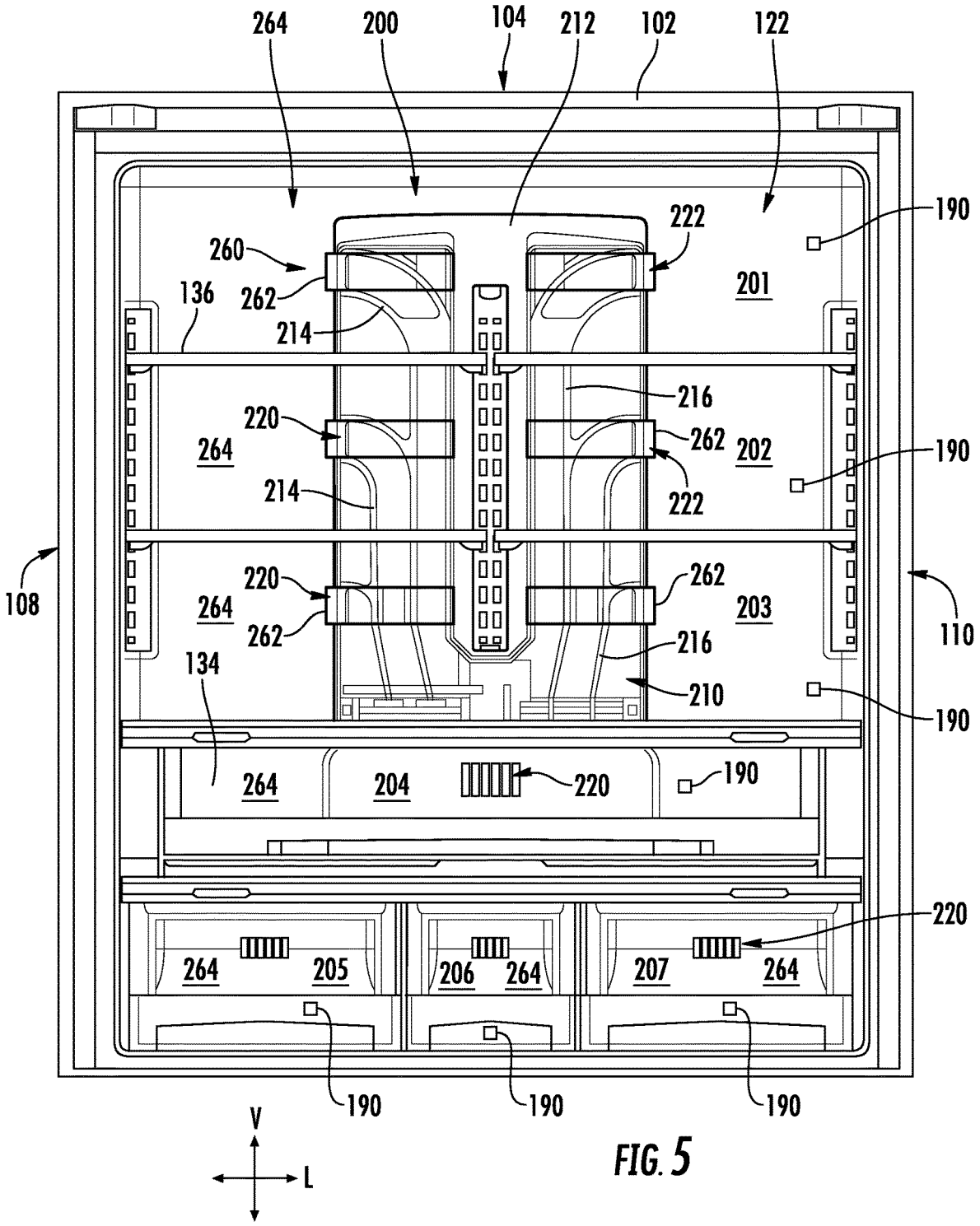
FIG. 5 provides a front view of a chilled chamber of the exemplary refrigerator appliance of FIG. 1, with a rear panel and other components illustrated in phantom to reveal components of a climate control system according to an exemplary embodiment of the present subject matter.

In this regard, as best shown in FIG. 5, sealed system 172 may include a compressor 174, a condenser 176, an expansion device 178, and one or more evaporators 180 connected in series by a fluid conduit that is charged with a refrigerant. Within sealed system 172, refrigerant flows into compressor 174, which operates to increase the pressure of the refrigerant. This compression of the refrigerant raises its temperature, which is lowered by passing the refrigerant through condenser 176. Within condenser 176, heat exchange with ambient air takes place so as to cool the refrigerant. A condenser fan 182 may be used to pull air across condenser 176, so as to provide forced convection for a more rapid and efficient heat exchange between the refrigerant within condenser 176 and the ambient air. Thus, as will be understood by those skilled in the art, increasing air flow across condenser 176 can, e.g., increase the efficiency of condenser 176 by improving cooling of the refrigerant contained therein.

An expansion device 178 (e.g., an electronic expansion valve, capillary tube, or other restriction device) receives refrigerant from condenser 176. From expansion device 178, the refrigerant enters evaporator 180. Upon exiting expansion device 178 and entering evaporator 180, the refrigerant drops in pressure. Due to the pressure drop and/or phase change of the refrigerant, evaporator 180 is relatively cool. An evaporator fan 184 is typically provided at each evaporator 180, e.g., to force air across and around the at least one evaporator 180 to transfer thermal energy from the air to the evaporator 180 (and more particularly, to the working fluid or refrigerant therein).

In this manner, a flow of cooling air (identified herein generally by reference numeral 186) exits the evaporator 180 and may be distributed to one or more of the chilled chambers 122 and/or 124. Specifically, one or more ducts may extend between the mechanical compartment 170 and the chilled chambers 122 and/or 124 to provide fluid communication therebetween, e.g., to provide chilled air 186 from the hermetically sealed cooling system 172, e.g., from an evaporator 180 thereof, to one or more of the chilled chambers 122 and/or 124.

The sealed system 172 depicted and described herein is provided by way of example only. Thus, it is within the scope of the present subject matter for other configurations of the refrigeration system to be used as well. For example, according to alternative embodiments, sealed system 172 may include additional components, e.g., at least one additional evaporator, compressor, expansion device, and/or condenser. For example, refrigerator appliance 100 may have two or more split evaporators, e.g., one dedicated primarily to cooling fresh food chamber 122 and one dedicated primarily to cooling freezer chamber 124. In addition, alternative plumbing configurations, valves, and flow regulators may be used to route refrigerant throughout sealed system 172.

In some embodiments, refrigerator appliance 100 also includes one or more sensors that may be used to facilitate improved operation of refrigerator appliance 100, such as described below. For example, in order to obtain temperature measurements within one or more chilled chambers 122, 124 (or regions/zones within chilled chambers 122, 124), refrigerator appliance 100 may include a plurality of temperature sensors (identified herein generally by reference numeral 190). Controller 156 may be communicatively coupled with temperature sensors 190, may receive signals from these temperature sensors 190 that correspond to the temperature of an atmosphere or air within their respective locations, and may implement responsive action, e.g., by directing more or less cooling air 186 toward that region or chamber.

As used herein, "temperature sensor" or the equivalent is intended to refer to any suitable type of temperature measuring system or device positioned at any suitable location for measuring the desired temperature. Thus, for example, temperature sensors 190 may be any suitable type of temperature sensor, such as a thermistor, a thermocouple, a resistance temperature detector, etc. In addition, temperature sensors 190 may be positioned at any suitable location and may output a signal, such as a voltage, to a controller that is proportional to and/or indicative of the temperature of the air surrounding the temperature sensors 190. Although exemplary positioning of temperature sensors is described and illustrated herein, it should be appreciated that refrigerator appliance 100 may include any other suitable number, type, and position of temperature and/or other sensors according to alternative embodiments.

Figure 3:
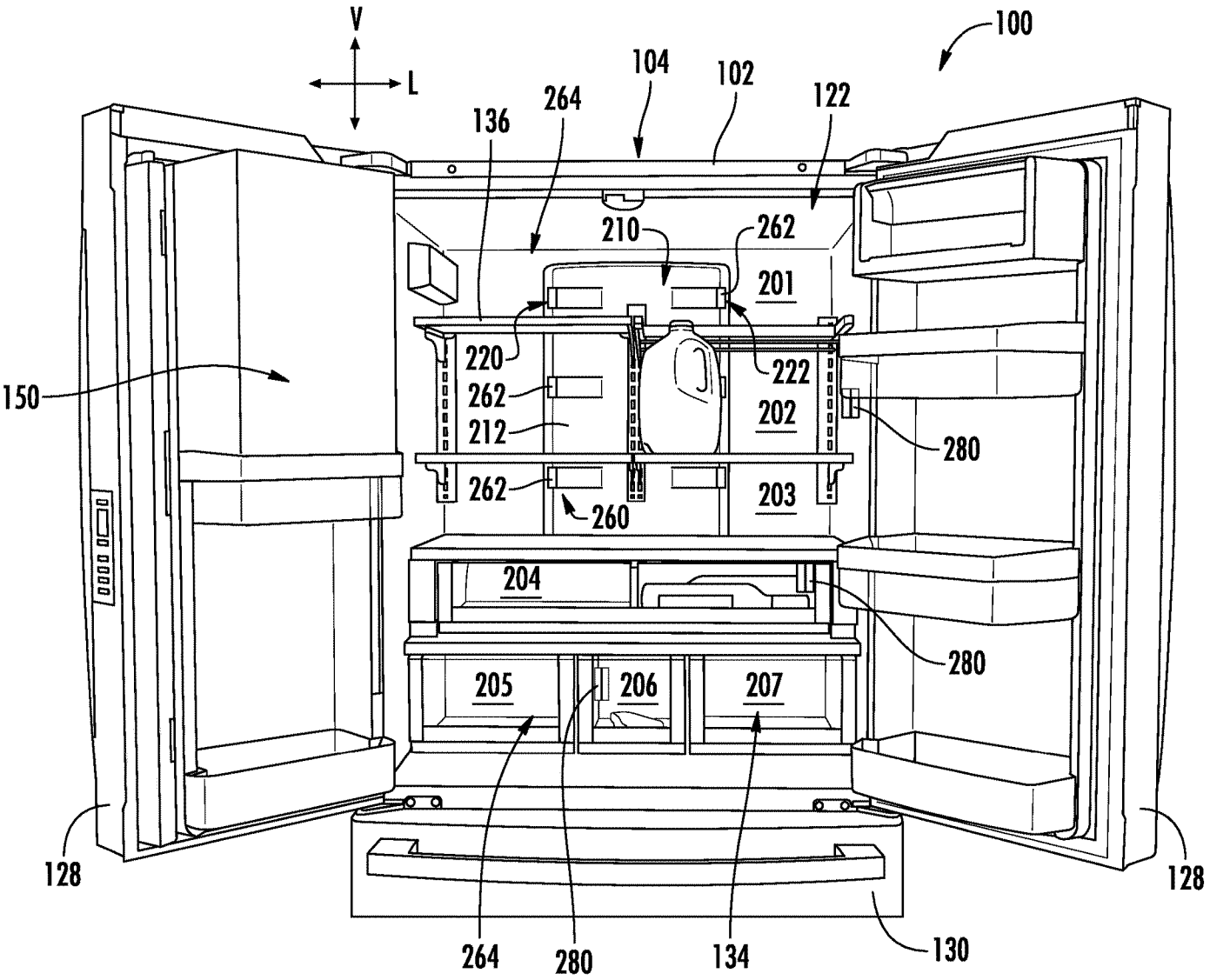
FIG. 3 provides another perspective view of the exemplary refrigerator appliance of FIG. 1, with the doors of the fresh food chamber shown in an open position.

Referring now generally to FIGS. 3 through 10, a climate control system 200 which may be used with refrigerator appliance 100 will be described according to exemplary embodiments of the present subject matter. In this regard, for example, climate control system 200 may generally include a sealed cooling system, such as sealed cooling system 172, for selectively regulating the temperature within fresh food chamber 122, freezer chamber 124, or with in specific zones in each of those chambers 122, 124. Specifically, as best shown in FIGS. 3 and 5, fresh food chamber 122 generally defines seven zones within which the temperature may be independently regulated by climate control system 200.

Specifically, these zones are identified in the figures as a first zone 201, a second zone 202, a third zone 203, a fourth zone 204, a fifth zone 205, a sixth zone 206, and a seventh zone 207. In this regard, for example, the first zone 201, the second zone 202, and the third zone 203 may be the primary storage zones which include or are defined in part by shelves 136 for supporting food items thereon. In addition, fourth zone 204 may be a convertible drawer or a deli storage drawer. Fifth zone 205, six zone 206, and seventh zone 207 may be positioned proximate a bottom of fresh food chamber 122 and may include crisper drawers or other produce storage drawers. It should be appreciated that the zone configuration described herein is only exemplary and is not intended to limit the scope of the present subject matter in any manner. Although climate control system 200 is described herein as being configured for selectively regulating the temperatures within each of zones 201-207, it should be appreciated that refrigerator appliance 100 may include any other suitable number and configuration of zones while remaining within the scope of the present subject matter.

In general, climate control system 200 may independently regulate a temperature within each of zones 201-207 by regulating the temperature and the flow rate of the flow of cooling air 186 received by each zone 201-207. For example, according to exemplary embodiments, the temperature of the flow of cooling air 186 may be regulated by adjusting the operation of sealed cooling system 172. In addition, refrigerator appliance 100 may further include a flow regulating assembly 210 for selectively diverting or regulating the flow of cooling air 186 throughout refrigerator appliance 100.

In this regard, flow regulating assembly 210 may include any suitable number and type of flow regulating devices, such as fans, air handlers, blowers, dampers, control valves, etc. In addition, flow regulating assembly 210 may include any suitable number of ducts or plumbing configurations for directing the flow of cooling air 186 as needed throughout cabinet 102. Although an exemplary flow regulating assembly 210 will be described below according to an exemplary embodiment, it should be appreciated that variations and modifications may be made to flow regulating assembly 210 and climate control system 200 while remaining within the scope of the present subject matter.

Referring now specifically to FIG. 5, portions of a liner positioned within cabinet 102 are illustrated in phantom to reveal aspects, components, and features of flow regulating assembly 210. Specifically, as illustrated, flow regulating assembly 210 may generally include an air distribution tower 212 that is generally configured for directing the flow of cooling air 186 to each of the respective cooling zones 201-207. A schematic representation of climate control system 200, including both sealed cooling system 172 and flow regulating assembly 210 is provided in FIG. 6 according to an exemplary embodiment of the present subject matter.

Figure 6:
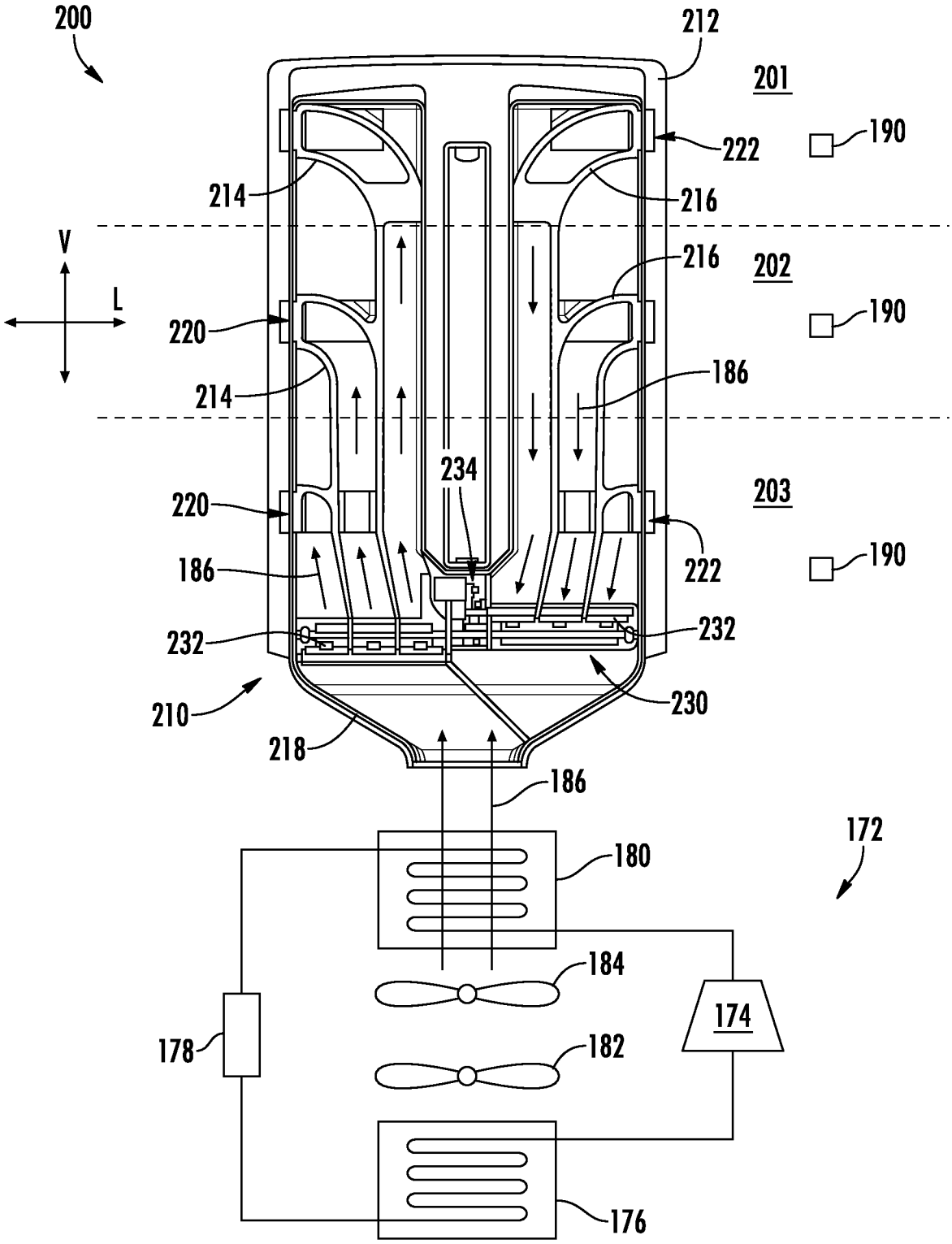
FIG. 6 provides a schematic view of the exemplary climate control system of FIG. 5 according to an exemplary embodiment of the present subject matter.
Figure 7:
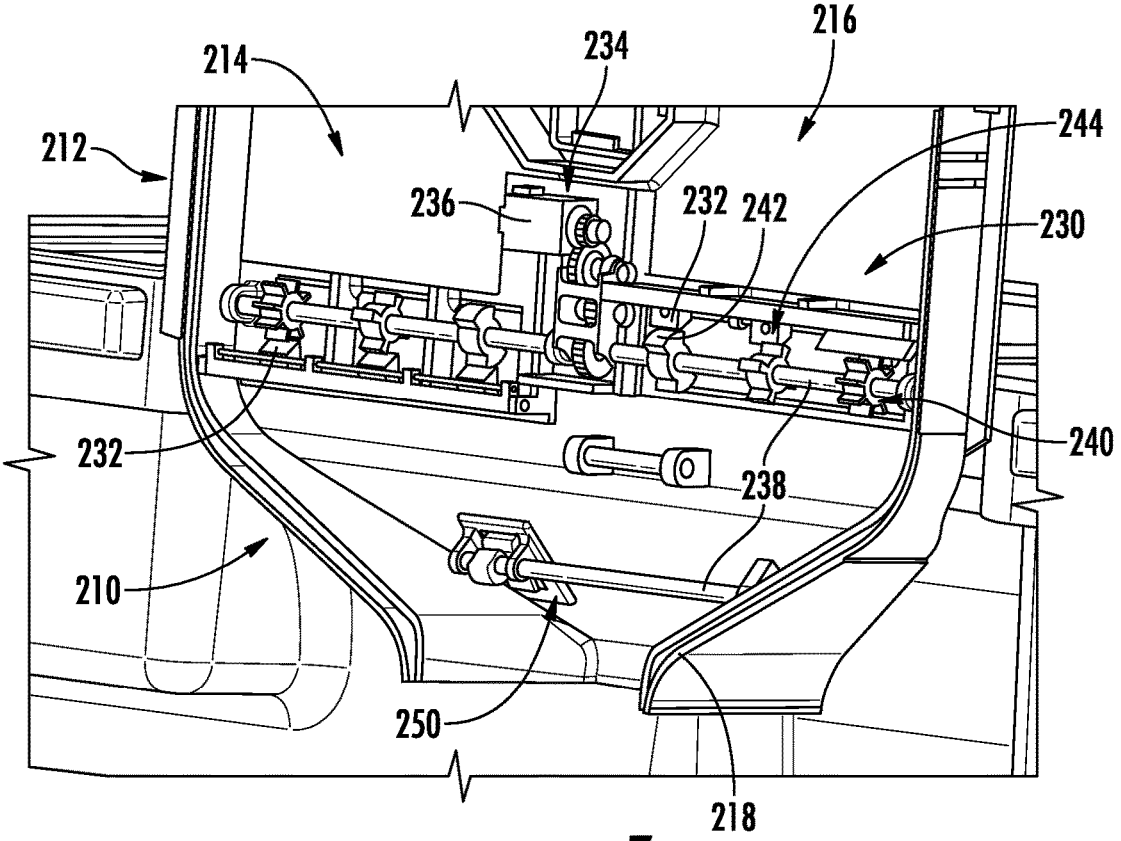
FIG. 7 provides a cross sectional view of a damper assembly of the exemplary climate control system of FIG. 5 according to exemplary embodiments of the present subject matter.
Figure 8:
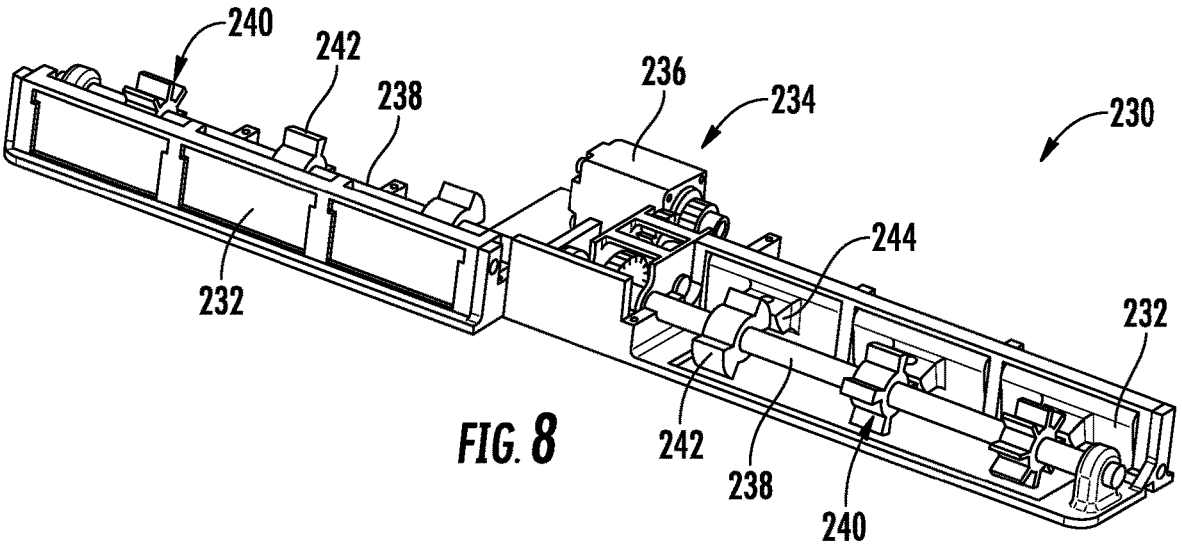
FIG. 8 provides a perspective view of the exemplary damper assembly of FIG. 7 according to an exemplary embodiment of the present subject matter.

As illustrated, air distribution tower 212 generally includes or defines one or more supply ducts 214 and one or more return ducts 216 that are fluidly coupled to sealed system 172 and to each of the respective zones 201-207. Referring specifically to FIG. 6, air distribution tower 212 defines a single supply duct 214 and a single return duct 216 for each of zones 201-203, i.e., six total ducts. These supply ducts 214 and return ducts 216 each extend from their respective zones to a central plenum 218, through which the flow of cooling air 186 is introduced to the air distribution tower 212.

In this regard, the flow of cooling air 186 may exit evaporator 180 of sealed cooling system 172 and enter central plenum 218. From central plenum 218, flow regulating assembly 210 may generally direct the flow of cooling air 186 throughout fresh food chamber 122 (e.g., through one or more of zones 201-207). In order to receive supply air and feedback return air, each zone 201-203 may include a supply port 220 which is fluidly coupled to the respective supply duct 214 and a return port 222 that is fluidly coupled to the respective return duct 216. In this manner, as shown for example in the illustrated embodiment of FIG. 6, the flow of cooling air 186 may pass upward through air distribution tower 212 before passing into zones 201-203 from a left side of air distribution tower 212 and returning back toward sealed system 172 through return ports 222 from the right side of air distribution tower 212.

Although each of zones 201-203 are illustrated as having dedicated supply and return ports 220, 222, it should be appreciated that according to exemplary embodiments, the fourth through seventh zones 204-207 may only include supply ports 220, and may not include dedicated return ports. For example, according to the illustrated embodiment, each of zones 204-207 include only supply ports 220 for providing the flow of cooling air 186 therein. Notably, the closed-loop flow of air may be achieved as the flow of cooling air 186 passes through cracks in or around storage bins 134 before returning back into central plenum 218 through a primary return (not shown) or through return ports 222 associated with zones 201-203. Other flow configurations are possible and within the scope of the present subject matter.

Referring now specifically to FIGS. 6 through 10, flow regulating assembly 210 may further include one or more damper assemblies 230 that are operably coupled to air distribution tower 212, central plenum 218, or other supply and return ducts for selectively directing the flow of cooling air 186 into zones 201-207 and throughout refrigerator appliance 100. In this regard, according to an exemplary embodiment, a pivoting damper 232 is operably coupled to each of the supply ducts 214 and return ducts 216 to regulate the flow of cooling air 186 through air distribution tower 212. In this manner, each damper 232 may be independently pivoted between an open position that permits the flow of cooling air 186 through the respective supply port 220 or return port 222 and a closed position that prevents the flow of cooling air 186 therethrough. In addition, it should be appreciated that damper 232 may be positioned at an intermediate position, e.g., to facilitate a partially restricted airflow.

As illustrated according to an exemplary embodiment, damper assembly 230 includes a drive mechanism 234 that generally includes a motor and/or transmission assembly 236 that is configured for rotating a drive shaft 238. Mounted along the drive shaft 238 are a plurality of mechanical actuators 240 that selectively and independently urge dampers 232 toward the open position. For example, according to the illustrated embodiment, each damper 232 may be spring-loaded toward the closed position and may be actuated toward the open position when a protrusion 242 on the respective mechanical actuator 240 engages a cam actuator 244 defined on damper 232. According to exemplary embodiments of the present subject matter, controller 156 may be configured for selectively opening and/or closing each damper 232 independently of each other to regulate the precise flow rates of the flow of cooling air 186 that passes into or is returned from each respective zone 201-207.

Figure 9:
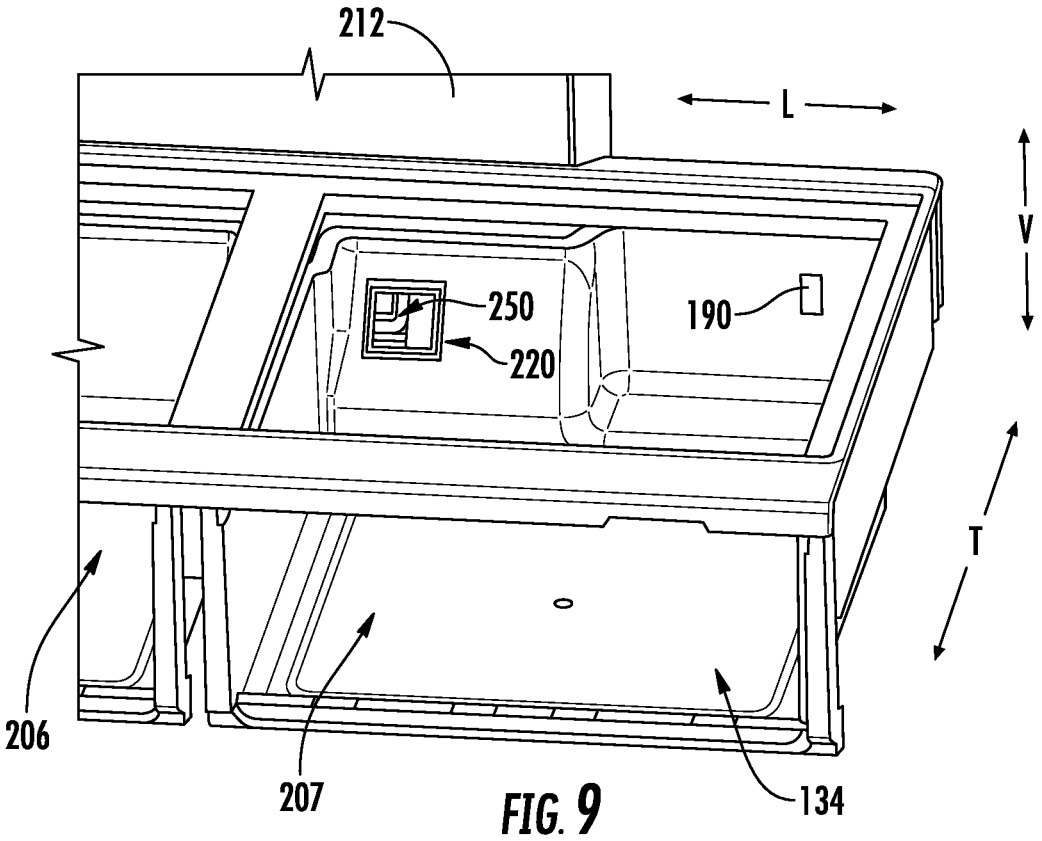
FIG. 9 provides a perspective view of a storage bin and a supply port defined within the storage bin according to an exemplary embodiment of the present subject matter.
Figure 10:
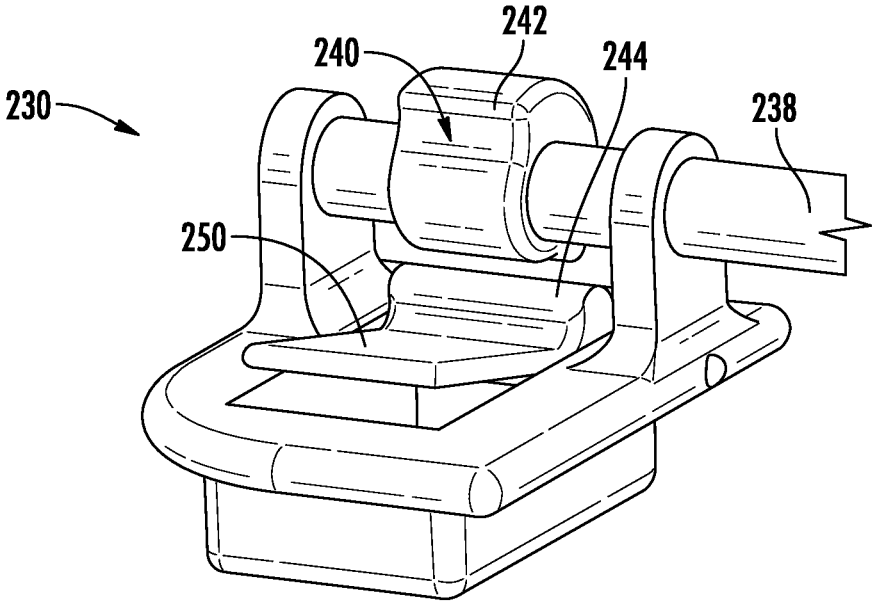
FIG. 10 provides a perspective view of a damper assembly that may be used with the exemplary storage bin of FIG. 9 according to an exemplary embodiment of the present subject matter.

Referring now briefly to FIGS. 9 and 10, zones 204-207 may also include damper assemblies 230 that are configured for regulating the flow of cooling air 186 therethrough. According to exemplary embodiments, these damper assemblies operate in the same manner as described above. For example, as shown in FIG. 9, storage bin 134 includes a supply port 220 that is defined proximate a rear side of storage bin 134. This rear side of storage bin 134 may be seated directly against central plenum 218, which may define an aperture (not shown) covered by a bin damper 250. In this regard, bin damper 250 may act in a manner the same or similar to dampers 232 to regulate the flow of cooling air 186 into storage bin 134. As noted above, air may be returned through air distribution tower 212 or through another return duct defined behind the storage bins 134.

Referring again to FIGS. 3 through 5, a lighting assembly 260 that may be used with refrigerator appliance 100 will be described according to exemplary embodiments of the present subject matter. Specifically, as explained briefly above, light assembly 260 is generally intended to provide an improved user experience with refrigerator appliance 100, e.g., by providing intuitive feedback to the user regarding the flow of cooling air throughout refrigerator appliance 100. In addition, lighting assembly 260 may be used to indicate when a particular zone 201-207 has reached its setpoint temperature, to identify flow restrictions or other operating issues, or to provide any other useful information to the user of refrigerator appliance 100.

Specifically, according to exemplary embodiments, lighting assembly 260 generally includes a plurality of light sources 262 positioned throughout fresh food chamber 122. Specifically, each of these light sources 262 may be positioned or oriented toward a plurality of lighting zones 264. These lighting zones 264 may correspond to the plurality of cooling zones 201-207. In this regard, each of cooling zones 201-207 includes one or more light sources 262 that may be operated as an independent light zone, e.g., to isolate and illuminate that particular zone to draw or focus a user's attention.

According to exemplary embodiments, it may be desirable to identify the location of supply port 220 and/or return port 222, e.g., to help a user avoid placing food items in locations which might block these ports 220, 222. For example, to inform the user of the location of supply port 220 and return port 222 in each of zones 201-203, light sources 262 may be positioned over or adjacent to at least one of supply port 220 and 222. In addition, or alternatively, light sources 262 may be positioned at any other suitable portion of zones 201-203. In addition, each of zones 204-207 may further include dedicated light sources 262 positioned therein for selectively illuminating each of the respective storage bins 134.

As used herein, the term "light sources" or the like may be used generally to refer to any suitable source of light for illuminating a refrigerator appliance 100 in any suitable manner. For example, light sources 262 may include any suitable number, type, position, and configuration of electrical light source(s), using any suitable light technology and illuminating in any suitable color. For example, according to the illustrated embodiment, light sources 262 includes one or more light emitting diodes (LEDs), which may each illuminate in a single color (e.g., white LEDs), or which may each illuminate in multiple colors (e.g., multi-color or RGB LEDs) depending on the control signal from controller 156. However, it should be appreciated that according to alternative embodiments, light sources 262 may include any other suitable traditional light bulbs or sources, such as halogen bulbs, fluorescent bulbs, incandescent bulbs, glow bars, a fiber light source, etc. In addition, it should be appreciated that refrigerator appliance 100 may include additional lighting, such as general chamber lighting that may illuminate the entire fresh food chamber 122 and/or freezer chamber 124.

Notably, controller 156 may be configured for operating lighting assembly 260 in order to provide useful information to a consumer or user of refrigerator appliance 100. In this regard, for example, it may be useful to a user of refrigerator appliance 100 to know when the flow of cooling air 186 is being provided and into which zones 201-207 it is being routed. In this regard, according to exemplary embodiments, light sources 262 may be illuminated in those zones where the flow of cooling air 186 is currently being directed, e.g., based at least in part on the positioning of damper assembly 230.

In addition, it should be appreciated that the lighting effects generated by lighting assembly 260 may be adjusted to indicate different operating conditions or identify particular situations. For example, light sources 262 may flash to indicate air is being directed into a particular zone 201-207. In addition, light sources 262 may become constant when a particular zone 201-207 has reached a setpoint temperature. In this regard, for example, light sources 262 may flash as a particular zone is being cooled but may become constant once the setpoint temperature is reached. Thereafter, light sources 262 may remain at a constant intensity until the temperature within that respective zone 201-207 falls below or exceeds a predetermined temperature range from the temperature set point, e.g., such as plus or minus 3° F. from the setpoint, plus or minus 5° F. from the setpoint, or any other suitable temperature range. It should be appreciated that other variations of light sources 262 may be used to provide useful information to the user, such as changes in color, intensity, sequence, flashing cadence, or any other suitable variation.

According still other embodiments, light sources 262 may be able to inform the user when an airflow restriction has occurred. For example, if a user positions a gallon of milk directly in front of supply port 220 or return port 222, climate control system 200 may no longer be capable of cooling that respective zone to the setpoint temperature. For example, controller 156 may detect such an airflow restriction by monitoring the temperature in the zone 201-207 that is restricted. If the temperature within the restricted zone has not reached the setpoint temperature within a predetermined amount of time, controller 156 may presume that the airflow to that particular zone 201-207 is restricted and may provide a user notification of the restriction. Specifically, when controller 156 detects a restriction, light source 262 and that respective zone 201-207 may flash rapidly, may turn red, or may illuminate in any other color or intensity to inform the user of the airflow restriction.

Figure 4:
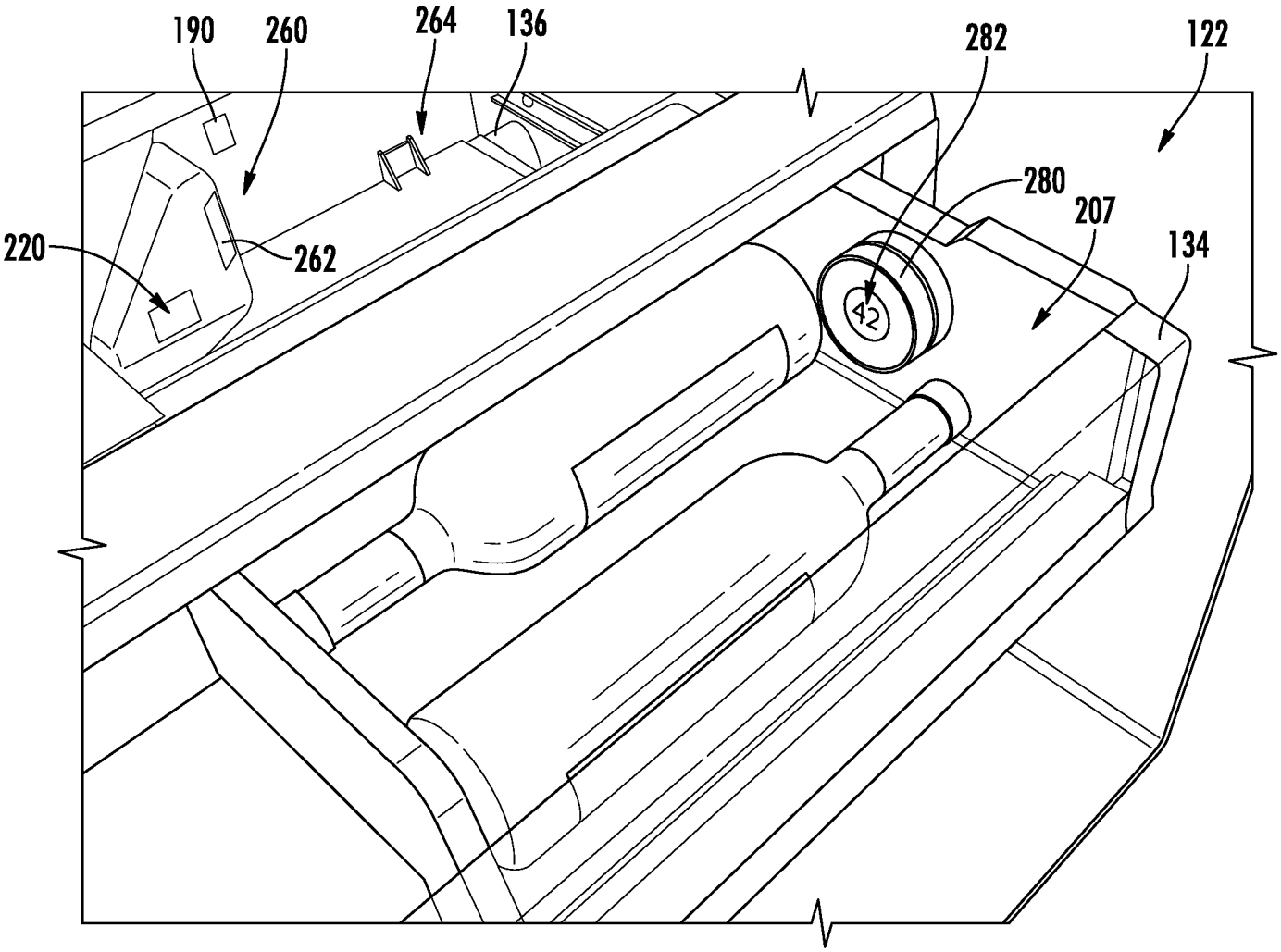
FIG. 4 provides a perspective view of a storage drawer of the exemplary refrigerator appliance of FIG. 1 according to an exemplary embodiment of the present subject matter.

Notably, according to exemplary embodiments, the setpoint temperature for each zone 201-207 may be set by a user of refrigerator appliance 100. For example, the user may input setpoint temperatures using control panel 152 or using a remote device that is communicatively coupled with controller 156, such as a mobile phone running a software application. However, according to still other embodiments, such as illustrated in FIGS. 3 and 4, refrigerator appliance 100 may include or be operable with a temperature control module 280 which is selectively positionable in one of the plurality of zones 201-207. The temperature control module 280 may be operable to and configured to communicate, e.g., wirelessly, with the controller 156. The controller 156 may locate the temperature control module 280, e.g., determine which zone of the plurality of zones 201-207 the temperature control module 280 is located or placed in, and the controller 156 may then adjust operation of the refrigerator appliance 100, e.g., the climate control system 200, to adjust a temperature within the zone in which the temperature control module 280 is located based on a temperature setting received by the controller 156 from the temperature control module 280.

In some embodiments, the temperature control module 280 may include a user interface 282, e.g., a touchscreen interface, for receiving input such as temperature settings from a user and/or for providing information to a user, such as displaying visual indicators and/or temperature readings or settings, etc. In some embodiments, the temperature control module 280 may also or instead receive the user input from a remote user interface device, such as a personal computer, smartphone, tablet, smart home system, or other similar device. For example, the remote user interface device may be a smartphone and may run an application or "app," whereby the remote user interface device can receive a temperature setting in the app and then transmit the temperature setting wirelessly to the temperature control module 280.

In some embodiments, the refrigerator appliance 100 may include one or more wireless receivers (not shown), e.g., antennas, which is or are coupled to the controller 156 for sending and receiving signals to and from the controller 156 and the temperature control module 280, e.g., the controller 156 may communicate with the temperature control module 280 wirelessly via the one or more antennas. In embodiments which include more than one of the wireless receivers, the controller 156 may be configured for locating the temperature control module 280 based on a wireless signal received from the temperature control module 280 via the more than one wireless receivers. For example, the controller 156 may be configured for locating the temperature control module 280 by triangulating the received wireless signal with the plurality of wireless receivers.

According to exemplary embodiments, the refrigerator appliance 100 may also or instead include a plurality of docking ports (not shown) that correspond to each of zones 201-207. For example, each docking port may be located in one of the plurality of zones 201-207, and each zone of the plurality of zones 201-207 may have one docking port therein. The docking ports may each be configured, e.g., sized and shaped, to receive the temperature control module 280 therein. For example, the temperature control module 280 may be generally puck-shaped, e.g., may be cylindrical with a diameter that is several times larger, e.g., two or three time larger, than the longitudinal axis. In such embodiments, the docking ports may be shallow cylindrical recesses within each zone 201-207 such that the temperature control module 280 may nest partially within the respective docking port for the zone in which the temperature control module 280 is located.

Also, each docking port may include a mechanical switch (not shown) that is contacted by a temperature control module 280 when seated within docking port. In this manner, controller 156 may be configured to locate the temperature control module 280 based on a signal received from the mechanical switch when the mechanical switch is actuated by the temperature control module 280 located in the corresponding docking port.

Now that the construction and configuration of refrigerator appliance 100, a climate control system 200, and lighting assembly 260 have been presented according to an exemplary embodiment of the present subject matter, an exemplary method 300 for operating a climate control system and a lighting assembly in a refrigerator appliance is provided. Method 300 can be used to operate climate control system 200 and lighting assembly 260, or to operate any other climate regulation and lighting assembly. In this regard, for example, controller 156 may be configured for implementing method 300. However, it should be appreciated that the exemplary method 300 is discussed herein only to describe exemplary aspects of the present subject matter, and is not intended to be limiting.

Figure 11:
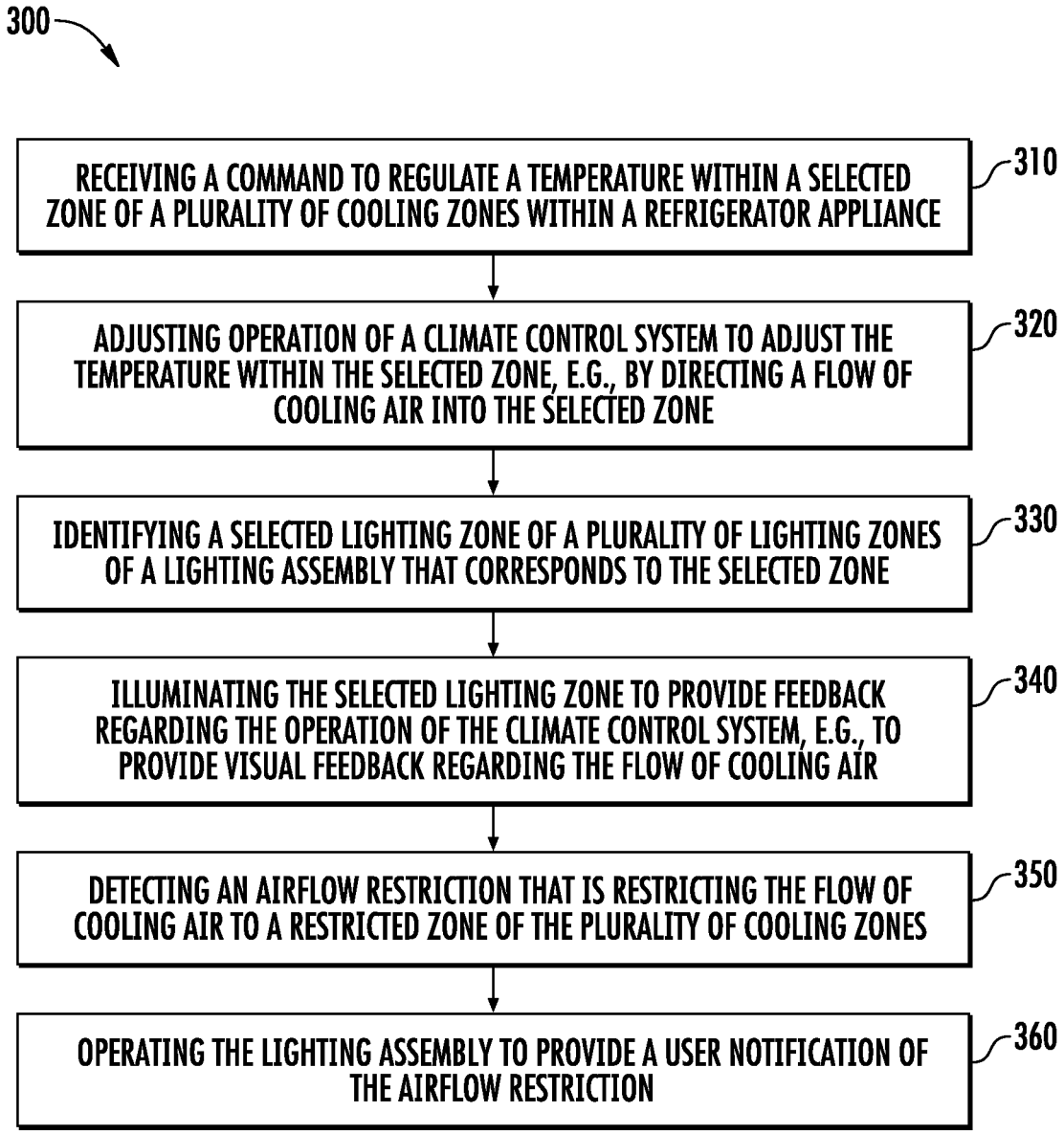
FIG. 11 provides a method of operating a refrigerator appliance and a lighting assembly according to an exemplary embodiment of the present subject matter.

As shown in FIG. 11, method 300 includes, at step 310, receiving a command to regulate a temperature within a selected zone of the plurality of cooling zones within a refrigerator appliance. In this regard, the command may be received from a user to regulate a specific zone e.g., one or more of zones 201-207, to a specific set point temperature. According to exemplary embodiments, the command may be received from a user via control panel 152 via inputs 154, from a remote device such as a mobile phone, or from a temperature control module 280. In the event the setpoint temperature is received from temperature control module 280, step 310 may further include identifying the zone where the temperature control module 280 is located, e.g., in a manner described above, and adjusting a temperature in the zone corresponding to that location. Notably, as explained above, each zone 201-207 of fresh food chamber 122 may be commanded to operate at a different setpoint temperature.

Step 320 includes adjusting operation of a climate control system to adjust the temperature within the selected zone, e.g., by directing a flow of cooling air into the selected zone. In this regard, for example, climate control system may operate sealed cooling system 172 to generate a flow of cooling air 186 and may use flow regulating assembly 210 and/or damper assembly 230 to split and direct the flow of cooling air 186 independently into each of zones 201-207 to independently control the temperature within each zone 201-207. Notably, as described above, it may be desirable to provide a user with information regarding the operation of climate control system, e.g., such as where the flow of cooling air 186 being directed.

Accordingly, step 330 may include identifying a selected lighting zone of a plurality of lighting zones of a lighting assembly that corresponds to the selected zone. In this regard, as explained above according to an exemplary embodiment, lighting assembly 260 may have a plurality of light sources 262 positioned in zones 264 that correspond to zones 201-207. When the selected zone 201-207 (e.g., as selected in step 310 and 320) is having temperature regulated by climate control system 200, the light sources 262 within the corresponding lighting zone 264 may be illuminated to provide useful information regarding the operation of refrigerator appliance 100.

Specifically, step 340 may include illuminating the selected lighting zone to provide feedback regarding the operation of the climate control system, e.g., to provide visual feedback regarding the flow of cooling air. In this manner, once the setpoint is obtained and climate control system 200 starts pumping the flow of cooling air 186 toward a particular zone, the light sources 262 corresponding to that zone may begin flashing to inform the user that that particular zone is being actively cooled. Similarly, once that zone approaches or reaches the setpoint temperature, the lighting effects may change, e.g., such as by turning a solid color. If the temperature within that zone falls outside a range the surrounding the setpoint temperature, that lighting zone 264 may implement still another lighting effect, such as flashing, changing color, etc.

According to still other embodiments, method 300 may include, at step 350, detecting an airflow restriction that is restricting the flow of cooling air to a restricted zone of the plurality of cooling zones. For example, the airflow restriction may be detected by determining that a particular zone is not reaching its setpoint temperature after a predetermined amount of time. The predetermined amount of time may be selected in any suitable manner or determined by controller 156 as the average amount of time necessary for a zone to reach its setpoint temperature, as how long it take to adjust a zone by a predetermined number of degrees, etc.

Step 360 may include operating the lighting assembly to provide a user notification of the airflow restriction. In this regard, when controller 156 determines that there is an airflow restriction, e.g., based on the inability to reach the setpoint temperature, controller 156 may implement a lighting sequence that brings the user's attention to the fact that there is an airflow restriction. According to exemplary embodiments, controller 156 may predict the precise supply port 220 or return port 222 where the restriction has occurred and may flash light sources 262 positioned over that respective port 220, 222. According still other embodiments, controller 156 may illuminate all light sources 262 within the restricted zone in a solid red color, thereby indicating the airflow restriction or another issue with climate control system 200.

FIG. 11 depicts an exemplary control method having steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of the methods are explained using refrigerator appliance 100, climate control system 200, and lighting assembly 260 as an example, it should be appreciated that these methods may be applied to the operation of any suitable appliance, climate control system, and/or lighting assembly.

Aspects of the present subject matter provide a refrigerator lighting system with a sequence of lighting effects to provide visual feedback based on the operation of a sealed refrigeration system, a flow regulating system, or the general flow of air within the refrigerator appliance. For example, a refrigerator controller is operably coupled to a refrigerator lighting system for illuminating a sequence of lighting effects based on the state of air flow system and user commands. This decorative lighting feedback system enhances the product performance along with user experience and perception of appliance quality.

According to exemplary embodiment, when the user places food in a particular zone and selects an associated zone temperature, the refrigerator lighting system may illuminate that zone in a particular sequence, color, or intensity, thereby highlighting the zone and providing intuitive feedback to the user. According to exemplary embodiments, the lighting sequence, color, or other characteristics may change, e.g., depending on the temperature of the airflow, the temperature of the zone relative to the setpoint temperature, or both.

For instance, light in a particular zone may being flashing when the sealed refrigeration system or flow regulating device is delivering cold airflow, indicating that the product is working and the chamber is approaching the temperature setpoint. Further, lighting-based feedback (e.g., via flashing, selective colors, etc.) may be used to show whether the temperature in that particular zone has reached to the user set temperature or not. For example, flashing or colors can be used to show the zone is not yet at the set temperature, but a steady light or color change might indicate the zone is at the user set temperature, or within a range surrounding the set temperature. Thus, the user can visually recognize the airflow condition in each particular zone and throughout the entire refrigerator appliance.

According to still other embodiments, the refrigerator lighting system could be used to alert the user when an airflow path is blocked and preventing proper operation. Moreover, the refrigerator lighting system could be used in conjunction with an independent temperature controller (e.g., using an independent temperature regulation module or temperature regulating puck) to provide feedback to the user of the zone which the temperature control module is controlling.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet;

a chilled chamber defined within the cabinet, the chilled chamber comprising a plurality of cooling zones;

a climate control system for selectively providing a flow of cooling air into the plurality of cooling zones such that each zone of the plurality of cooling zones is cooled independently of every other zone of the plurality of cooling zones;

a lighting assembly comprising a plurality of lighting zones corresponding to the plurality of cooling zones; and a controller in operative communication with the climate control system and the lighting assembly, the controller being configured to:

receive a command to regulate a temperature within a selected zone of the plurality of cooling zones;

adjust operation of the climate control system to adjust the temperature within the selected zone;

identify a selected lighting zone of the plurality of lighting zones that corresponds to the selected zone; and illuminate the selected lighting zone to provide feedback regarding the operation of the climate control system.

2. The refrigerator appliance of claim 1, wherein illuminating the selected lighting zone comprises:

flashing one or more light sources within the selected lighting zone when the flow of cooling air is being directed into the selected zone.

3. The refrigerator appliance of claim 1, wherein illuminating the selected lighting zone comprises:

energizing one or more light sources within the selected lighting zone to generate constant light when the temperature in the selected zone reaches a setpoint temperature.

4. The refrigerator appliance of claim 3, wherein illuminating the selected lighting zone further comprises:

maintaining the constant light from the one or more light sources while the temperature in the selected zone remains within a predetermined range of the setpoint temperature.

5. The refrigerator appliance of claim 1, wherein the controller is further configured to:

detect an airflow restriction that is restricting the flow of cooling air to a restricted zone of the plurality of cooling zones; and operate the lighting assembly to provide a user notification of the airflow restriction.

6. The refrigerator appliance of claim 5, wherein operating the lighting assembly to provide the user notification comprises:

identifying a restricted lighting zone of the plurality of lighting zones that corresponds to the restricted zone; and emitting a red light from one or more light sources within the restricted lighting zone to identify the airflow restriction.

7. The refrigerator appliance of claim 5, wherein detecting the airflow restriction comprises:

monitoring a temperature in the restricted zone; and determining that the temperature in the restricted zone has not reached a setpoint temperature for the restricted zone within a predetermined amount of time.

8. The refrigerator appliance of claim 1, wherein the lighting assembly comprises:

a plurality of light sources, at least one light source being positioned within each of the plurality of cooling zones and being illuminated when the respective zone of the plurality of cooling zones is receiving the flow of cooling air.

9. The refrigerator appliance of claim 8, wherein the at least one light source is positioned over or adjacent to at least one of a supply port or a return port of the respective zone of the plurality of cooling zones.

10. The refrigerator appliance of claim 1, wherein the lighting assembly comprises at least one multi-color light emitting diode (LED).

11. The refrigerator appliance of claim 1, wherein the climate control system comprises:

a sealed cooling system in fluid communication with the chilled chamber for providing the flow of cooling air into the chilled chamber; and a flow regulating assembly for selectively diverting the flow of cooling air into the plurality of cooling zones.

12. The refrigerator appliance of claim 11, wherein the flow regulating assembly comprises:

a supply duct for providing the flow of cooling air into the chilled chamber; and a damper assembly operably coupled to the supply duct for selectively directing the flow of cooling air through the supply duct into the plurality of cooling zones within the chilled chamber.

13. The refrigerator appliance of claim 12, wherein the damper assembly comprises:

a plurality of dampers, each damper of the plurality of dampers positioned in or proximate to a respective one zone of the plurality of cooling zones, wherein adjusting the damper assembly to selectively direct the flow of cooling air through the supply duct into the plurality of cooling zones comprises adjusting a position of the damper of the plurality of dampers positioned in or proximate to the zone in which a temperature change is desired.

14. The refrigerator appliance of claim 1, further comprising a temperature control module selectively positionable in one of the plurality of cooling zones, the controller being configured to:

identify a zone within which the temperature control module is located;

receive a setpoint temperature from the temperature control module; and adjust operation of the climate control system to adjust a temperature in the zone to the setpoint temperature.

15. The refrigerator appliance of claim 14, further comprising:

a plurality of temperature sensors, each temperature sensor of the plurality of temperature sensors positioned in or proximate to a respective one zone of the plurality of cooling zones, and wherein the controller is in operative communication with the plurality of temperature sensors and is configured for adjusting operation of the climate control system based on a current temperature measured by one temperature sensor of the plurality of temperature sensors and the received setpoint temperature from the temperature control module.

16. A method of operating a refrigerator appliance, the refrigerator appliance comprising a chilled chamber defining a plurality of cooling zones, a climate control system for selectively providing a flow of cooling air into the plurality of cooling zones, and a lighting assembly comprising a plurality of lighting zones corresponding to the plurality of cooling zones, the method comprising:

receiving a command to regulate a temperature within a selected zone of the plurality of cooling zones;

adjusting operation of the climate control system to adjust the temperature within the selected zone;

identifying a selected lighting zone of the plurality of lighting zones that corresponds to the selected zone; and illuminating the selected lighting zone to provide feedback regarding the operation of the climate control system.

17. The method of claim 16, wherein illuminating the selected lighting zone comprises:

flashing one or more light sources within the selected lighting zone when the flow of cooling air is being directed into the selected zone.

18. The method of claim 16, wherein illuminating the selected lighting zone comprises:

energizing one or more light sources within the selected lighting zone to generate constant light when the temperature in the selected zone reaches a setpoint temperature; and maintaining the constant light from the one or more light sources while the temperature in the selected zone remains within a predetermined range of the setpoint temperature.

19. The method of claim 16, further comprising:

detecting an airflow restriction that is restricting the flow of cooling air to a restricted zone of the plurality of cooling zones; and operating the lighting assembly to provide a user notification of the airflow restriction.

20. The method of claim 19, wherein operating the lighting assembly to provide the user notification comprises:

identifying a restricted lighting zone of the plurality of lighting zones that corresponds to the restricted zone; and emitting a red light from one or more light sources within the restricted lighting zone to identify the airflow restriction.

* * * * *